US007239839B2

(12) United States Patent
Cho

(10) Patent No.: US 7,239,839 B2
(45) Date of Patent: Jul. 3, 2007

(54) FUSING DEVICE OF ELECTRO-PHOTOGRAPHIC IMAGE-FORMING APPARATUS AND METHOD OF USING

(75) Inventor: Durk-Hyun Cho, Suwon-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 79 days.

(21) Appl. No.: 10/998,038

(22) Filed: Nov. 29, 2004

(65) Prior Publication Data

US 2005/0141933 A1 Jun. 30, 2005

(30) Foreign Application Priority Data

Dec. 31, 2003 (KR) ..... 10-2003-0101579

(51) Int. Cl.
*G03G 15/20* (2006.01)

(52) U.S. Cl. ..... 399/329

(58) Field of Classification Search ..... 399/327, 399/328, 329, 330, 331, 333; 347/156
See application file for complete search history.

(56) References Cited

U.S. PATENT DOCUMENTS 5,729,812 A * 3/1998 Moser ..... 399/329
5,873,020 A * 2/1999 Matsuura et al. ..... 399/329
5,999,764 A * 12/1999 Okabayashi et al. .... 399/329 X
6,321,061 B1 * 11/2001 Sonobe et al. ..... 399/329
6,496,666 B2 * 12/2002 Hayashi et al. ..... 399/329 X
6,594,464 B2 * 7/2003 Hayashi et al. ..... 399/327 X
2003/0095819 A1 * 5/2003 Lee ..... 399/330
2003/0210937 A1 * 11/2003 Matsumoto ..... 399/327

FOREIGN PATENT DOCUMENTS

| | | |
|---|---|---|
| JP | 06-318000 | 11/1994 |
| JP | 2001-201978 | 7/2001 |
| JP | 2001-343849 | 12/2001 |
| JP | 2002-182500 | 6/2002 |
| JP | 2002-189364 | 7/2002 |
| JP | 2003-084597 | 3/2003 |
| JP | 2003-156961 | 5/2003 |
| JP | 2003-280443 | 10/2003 |

* cited by examiner

*Primary Examiner*—Sandra L. Brase
(74) *Attorney, Agent, or Firm*—Roylance, Abrams, Berdo & Goodman, L.L.P.

(57) ABSTRACT

A fusing device installed in an electro-photographic image forming apparatus and method are provided. The fusing device includes a fusing belt having a continuous belt for rotating while being supported by at least two rollers, receiving heat from the at least two rollers, and delivering the heat to an image transferred onto paper; and a pressurizing roller for contacting the continuous belt and applying pressure onto the paper.

29 Claims, 8 Drawing Sheets

FUSING DEVICE OF ELECTRO-PHOTOGRAPHIC IMAGE-FORMING APPARATUS AND METHOD OF USING

This application claims the benefit under 35 U.S.C. 119(a) of Korean Patent Application No. 2003-101579 filed on Dec. 31, 2003 in the Korean Intellectual Property Office, the entire contents of which is incorporated herein by reference.

BACKGROUND OF THE INVENTION

1. Field of the Invention

The present invention relates to an electro-photographic image forming apparatus and method of using the same. More particularly, the present invention relates to a fusing device installed in an electro-photographic image forming apparatus that applies heat and pressure onto an image so that the image can be fused to the paper and a method of using the same.

2. Description of the Related Art

In general, an electro-photographic image forming apparatus includes a fusing device that applies heat and pressure onto an image transferred onto paper so that the image can be fused onto the paper.

A heating unit 12 with a halogen lamp is installed in a center portion of the fusing roller 11. A surface of the fusing roller 11 is coated with a coating layer 11*a* comprising polytetrafluoroethylene. The heating unit 12 generates heat in the fusing roller 11 and the fusing roller 11 is heated by radiant heat generated by the heating unit 12.

The pressurizing roller 13 is resiliently supported by a spring 13*a*, and thus, capable of applying pressure onto the paper 14 passing between the fusing roller 11 and the pressurizing roller 13 so that the paper 14 can contact the fusing roller 11. Accordingly, when the paper 14 passes between the fusing roller 11 and the pressurizing roller 13, predetermined pressure and heat are applied onto a powder toner image 14*a* transferred to the paper 14. Thus, the powder toner image 14*a* is heated and fused onto the paper 14 by the predetermined heat and pressure applied by the fusing roller 11 and the pressurizing roller 13.

Use of a conventional fusing device, such as the fusing device 10 shown in FIG. 1, that adopts a halogen lamp as a heat source causes unnecessary power consumption. Accordingly, when no print job is required, the conventional fusing device is turned off to reduce its temperature. For this reason, when the conventional fusing device is turned on to perform a print job, it takes a long time to warm up until its temperature reaches a fusing temperature.

Since a fusing roller of the conventional fusing device is heated by radiant heat generated by the heat source, a heat transfer speed is slow. Also, since the heat of the heated fusing roller is delivered to paper when the paper contacts the fusing roller, it is impossible to timely compensate for a deviation in temperature caused by a reduction in the temperature, thus preventing adjustment of temperature dispersion.

Also, a nip caused when a pressurizing roller contacts the fusing roller has a narrow width, and thus, there is a limitation to forming an image at a high speed. To solve this problem, the nip width is increased by the diameter of the fusing roller or the pressurizing roller. However, in this case, the volume of the fusing device is increased.

To solve this problem, a fusing device with a continuous belt has been introduced. For instance, published Japanese Patent Publication No. 2003-156961 discloses a fusing device that includes a fusing roller that includes a heat source therein, and a continuous belt rotated while being supported by three rollers, facing the fusing roller. One of the three rollers is pressed toward the fusing roller due to a spring force, thus applying pressure onto the fusing roller, and a part of the continuous belt contacts and applies pressure onto the fusing roller by a pressure support pad. Thus, when paper with an image passes through a contact portion between the fusing roller and the continuous part, the image is heated and fused onto the paper.

Published Japanese Patent Publication No. 2002-182500 discloses a fusing device with a continuous belt, using electromagnetic induction. The fusing device includes the rotating continuous belt being supported by two rollers and a pressurizing roller that faces the continuous belt and is rotated to apply a pressure onto the continuous belt. An induction-heating unit that includes an induction-heating coil therein is installed on an inner surface of the continuous belt. A flux change in the induction-heating unit allows heat generated in a magnetic layer formed on the continuous belt to be delivered to paper passing through a contact nip between the continuous belt and the pressurizing belt, thereby fusing an image, which is transferred to the paper.

However, a high-thermal-capacity elastic layer of the continuous belt of the fusing device disclosed in published Japanese Patent Publication No. 2003-156961 is minimized, thus lowering the thermal storage capability of the fusing device. For this reason, the fusing device is inconvenient to use since it needs to be frequently charged, thereby increasing power consumption and causing flicker.

Also, the fusing device using electromagnetic heating, disclosed in published Japanese Patent Publication No. 2002-182500, requires the continuous belt to include a magnetic layer, thereby increasing manufacturing costs.

SUMMARY OF THE INVENTION

The present invention provides a fusing device installed in an electro-photographic image forming apparatus, in which a continuous belt can be quickly heated to a settling temperature and attain a uniform temperature distribution and a method thereof.

According to an aspect of the present invention, there is provided a fusing device and method installed in an electro-photographic image forming apparatus. The fusing device comprising a fusing belt having a continuous belt for rotating while being supported by at least two rollers, receiving heat from the at least two rollers, and delivering the heat to an image transferred to paper. The fusing further comprising a pressurizing roller for contacting the continuous belt and applying pressure onto the paper.

BRIEF DESCRIPTION OF THE DRAWINGS

The above and other aspects and advantages of the present invention will become more apparent by describing in detail exemplary embodiments thereof with reference to the accompanying drawings in which.

Throughout the drawings, it should be noted that the same or similar elements are denoted by like reference numerals.

DETAILED DESCRIPTION OF EXEMPLARY EMBODIMENTS

Figure 1:
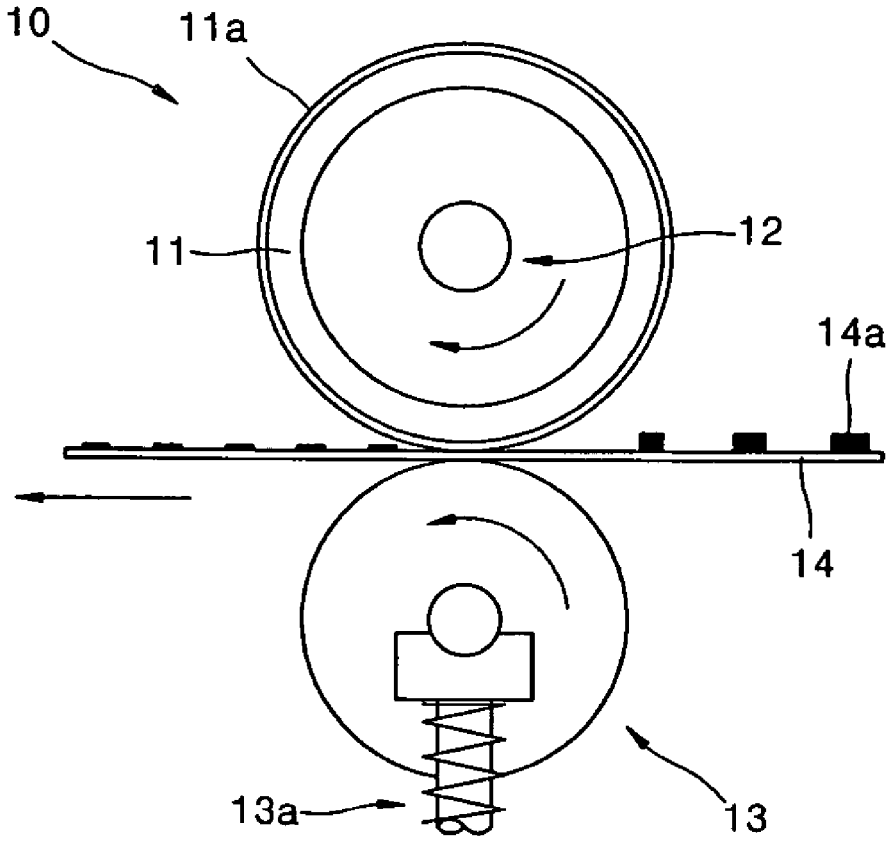
FIG. 1 (PRIOR ART)
FIG. 1 is a conventional two-roller type fusing device having a halogen lamp as a heat source.

Hereinafter, exemplary embodiments of the present invention will be described in detail with reference to the accompanying drawings. Like reference numerals will represent like elements throughout the drawings.

Figure 2:
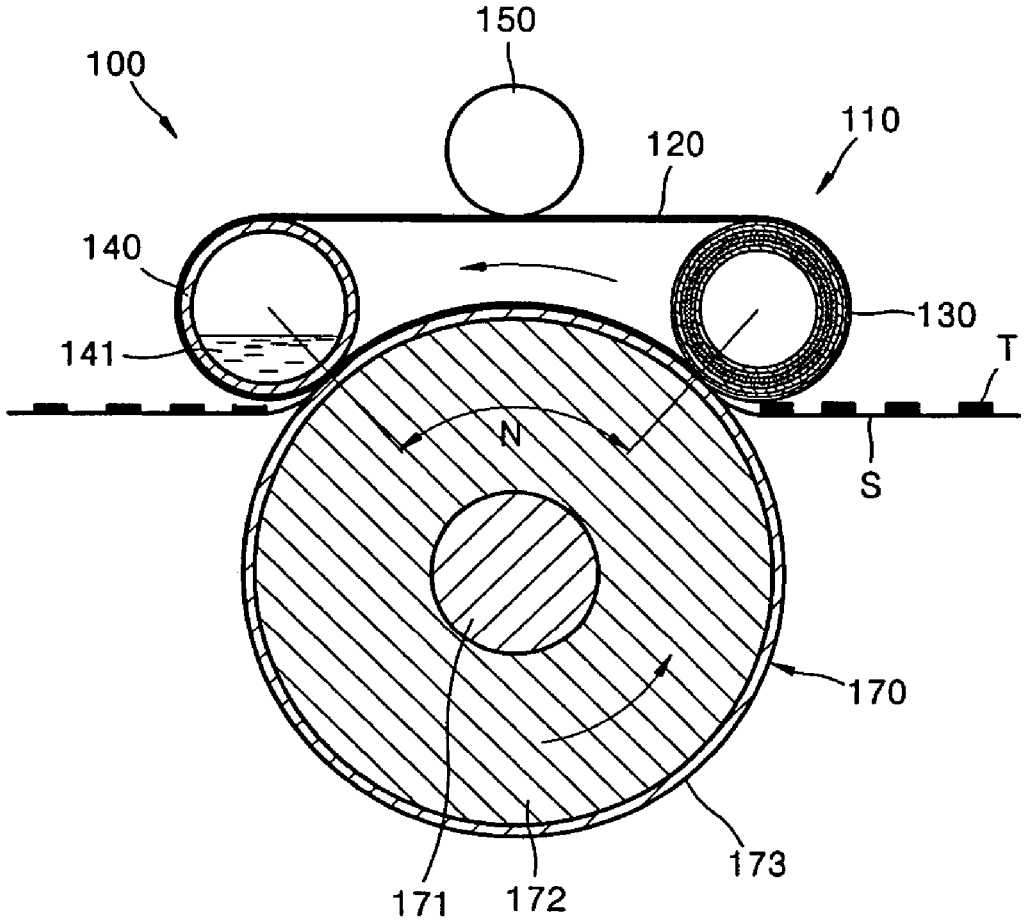
FIGS. 2 and 3 are cross-sectional views of a fusing device installed in an electro-photographic image forming apparatus, according to an embodiment of the present invention.

A fusing device 100 shown in FIG. 2, according to an embodiment of the present invention, includes a fusing belt 110 that includes a major heating roller 130, an auxiliary heating roller 140, and a continuous belt 120 that is rotated while being supported by the major and auxiliary heating rollers 130 and 140 and heated by the first major heating roller 130; and a pressurizing roller 170 that contacts the continuous belt 120, facing the fusing belt 110, and presses paper passing through a contact nip N between the continuous belt 120 and the pressurizing roller 170 toward the continuous belt 120.

Figure 8:
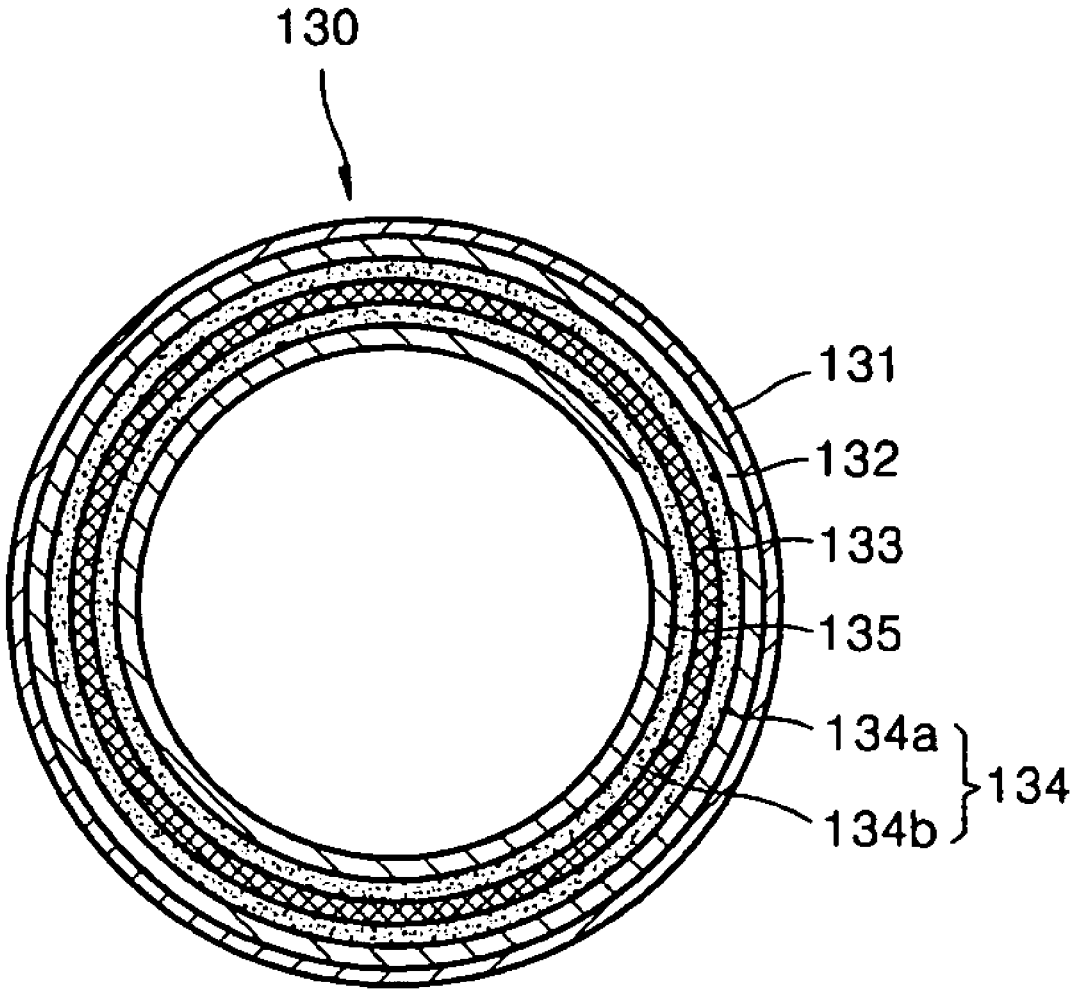
FIG. 8 is a cross-sectional view of a major heating roller included in a fusing device, according to an embodiment of the present invention.

The major heating roller 130 contacts an inner surface of the continuous belt 120. Also, as shown in FIG. 8, the major heating roller 130 includes an outer roller layer 132 with an outer circumference coated with a coating layer 131; a heating unit 133 that generates heat, has an outer circumference covered with a resistance heating coil, and is installed along a spindle of the major heating roller 130 in a spiral to contact an inner circumference of the outer roller layer 132; an inner roller layer 135; and an insulating layer 134 that includes a first insulating layer 134*a* between the heating unit 133 and the outer roller layer 132 and a second insulating layer 134*b* between the heating unit 133 and the inner roller layer 135. The outer roller layer 132, the first insulating layer 134*a*, the heating unit 133, the second insulating layer 134*b*, and the inner roller layer 135 are adhered closely to one another.

Referring to FIG. 2, the auxiliary heating roller 140 comprises a heat pipe that has a high heat storage capability and contains a working fluid 141 therein. When the auxiliary heating roller 140 contacts the continuous belt 120, the auxiliary heating roller 140 heated by the first major heating roller 130 and stores the heat, thereby making the temperature of the continuous belt 120 uniform. The auxiliary heating roller 140 preferably comprises copper (Cu) having a high heat transfer efficiency, especially, oxygen-free copper with a degree of purity of 99.99% or greater.

Either the first major roller 130 or the auxiliary heating roller 140 acts as a driving unit that rotates the continuous belt 120.

The pressurizing roller 170 includes an elastic layer 172 covering a rotating shaft 171, and a coating layer 173 comprising polytetrafluoroethylene along an outer circumference of the elastic layer 172.

Figure 3:
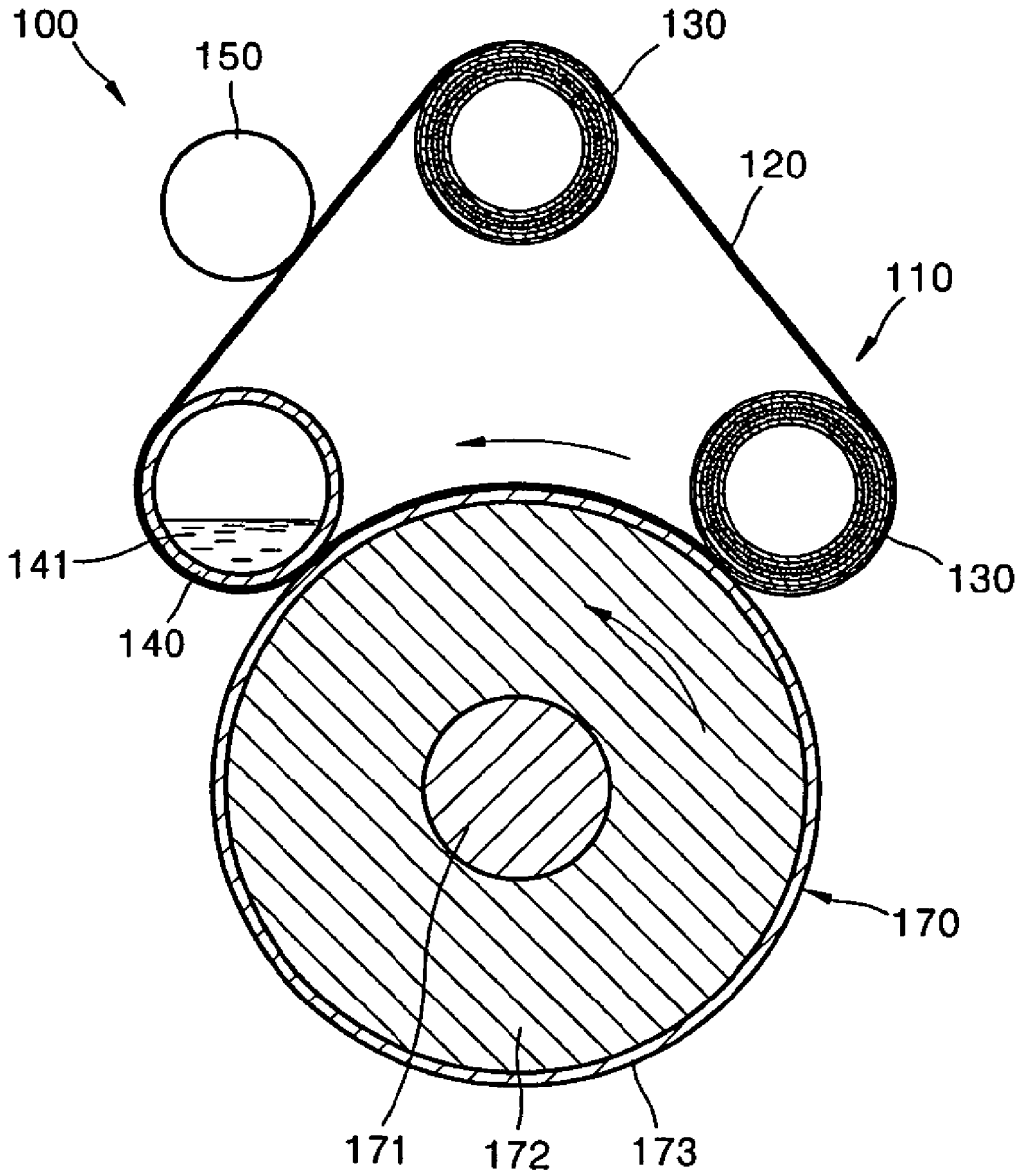

As shown in FIG. 3, the fusing belt 110 may include a further major heating roller 130 that contacts the continuous belt 120. In this case, the major heating rollers 130 and the auxiliary heating roller 140 are installed in a triangle to support and rotate the continuous belt 120.

If the fusing device 100 such as that shown in FIGS. 2 and 3 has the two heating rollers 130, the amount of heat delivered to the continuous belt 120 becomes greater than when only the first major heating roller 130 is used.

Also, the fusing device 100 further includes a cleaning roller 150 for contacting an external surface of the continuous belt 120 and removing residual substances remaining on the continuous belt 120.

The operation of a fusing device, such as that shown in FIGS. 2 and 3, according to an embodiment of the present invention will now be described.

When paper S to which an image T is transferred passes through a contact nip N of the continuous belt 120 and the pressurizing roller 170, heat generated by the first major heating roller 130 is sequentially transmitted to the continuous belt 120 and the image T.

In this case, when the auxiliary heating roller 140 contacts the continuous belt 120, it is heated and stores the heat. In other words, the continuous belt 120 is heated by the heat generated by the major heating roller 130 and has a uniform temperature distribution due to the auxiliary heating roller 140.

Also, when the paper S passes through the contact nip N, it is heated by the continuous belt 120 and pressed against the continuous belt 120 by the pressurizing roller 170, thus fusing the image T onto the paper S.

Figure 4:
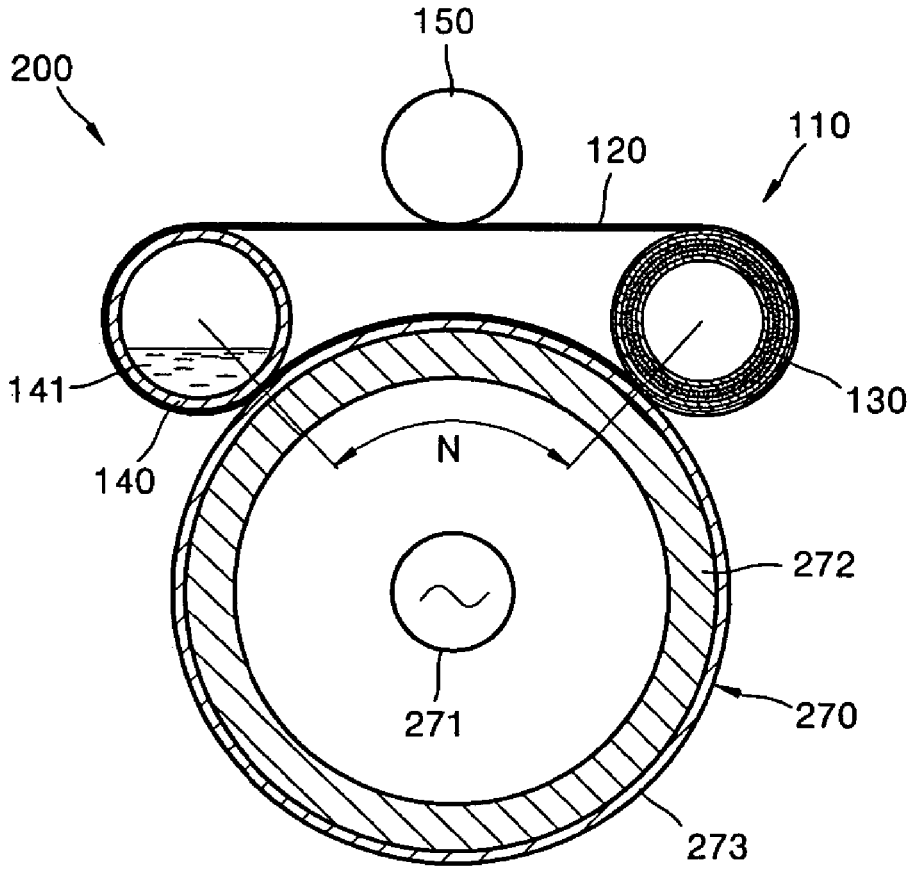
FIGS. 4 and 5 are cross-sectional views of a fusing device installed in an electro-photographic image forming apparatus, according to another embodiment of the present invention.
Figure 5:
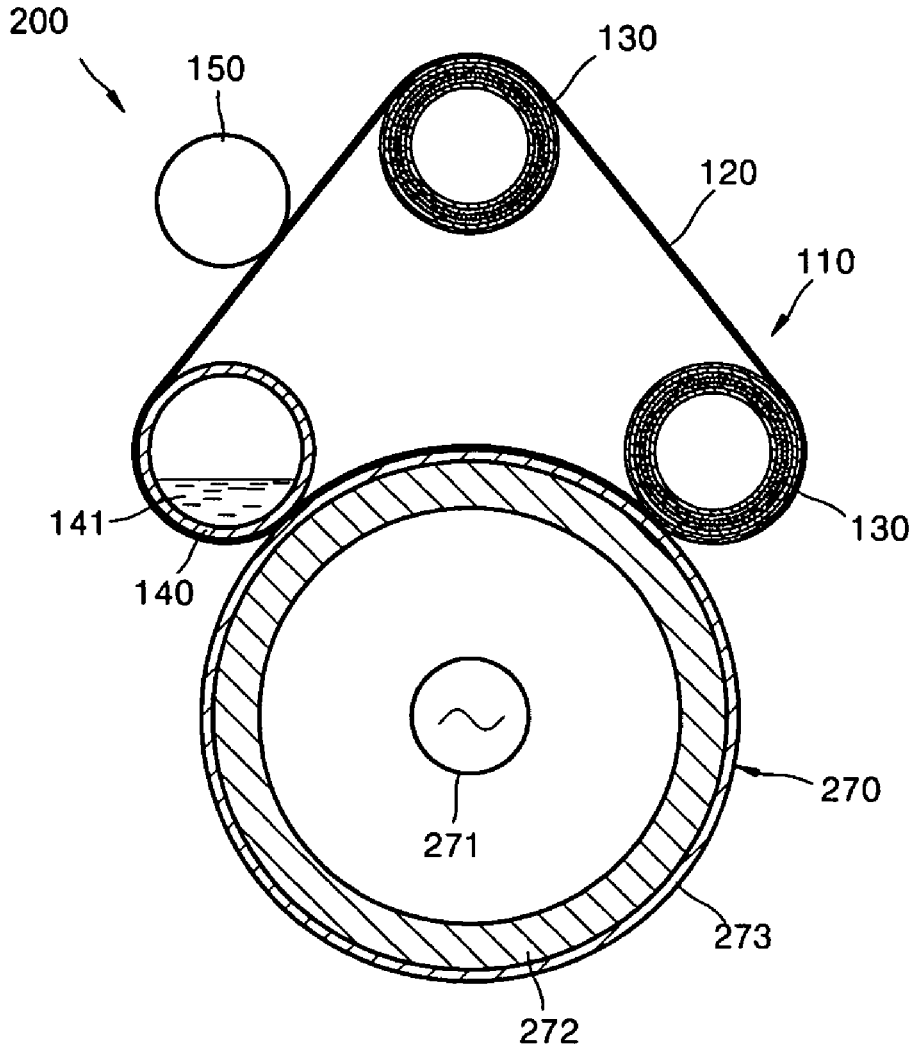

Referring to FIGS. 4 and 5, a fusing device 200 according to another embodiment of the present invention includes a fusing belt 110 such as the fusing device shown in FIGS. 2 and 3, and a pressurizing roller 270.

The pressurizing roller 270 includes an elastic layer 272 and a coating layer 273, and includes a heat source 271 therein. The heat source 271 is preferably a halogen lamp.

Heat generated from the heat source 271 circulates in air and is delivered to an image T such as that shown in FIG. 2 via the elastic layer 272 and the foreign layer 273. That is, when paper S such as that shown in FIG. 2 with the image T passes through the contact nip N, not only the continuous belt 120 applies heat and pressure onto the image T but also the continuous belt 120 delivers the heat to the image T. As a result, the image T is fused onto the paper S.

Figure 6:
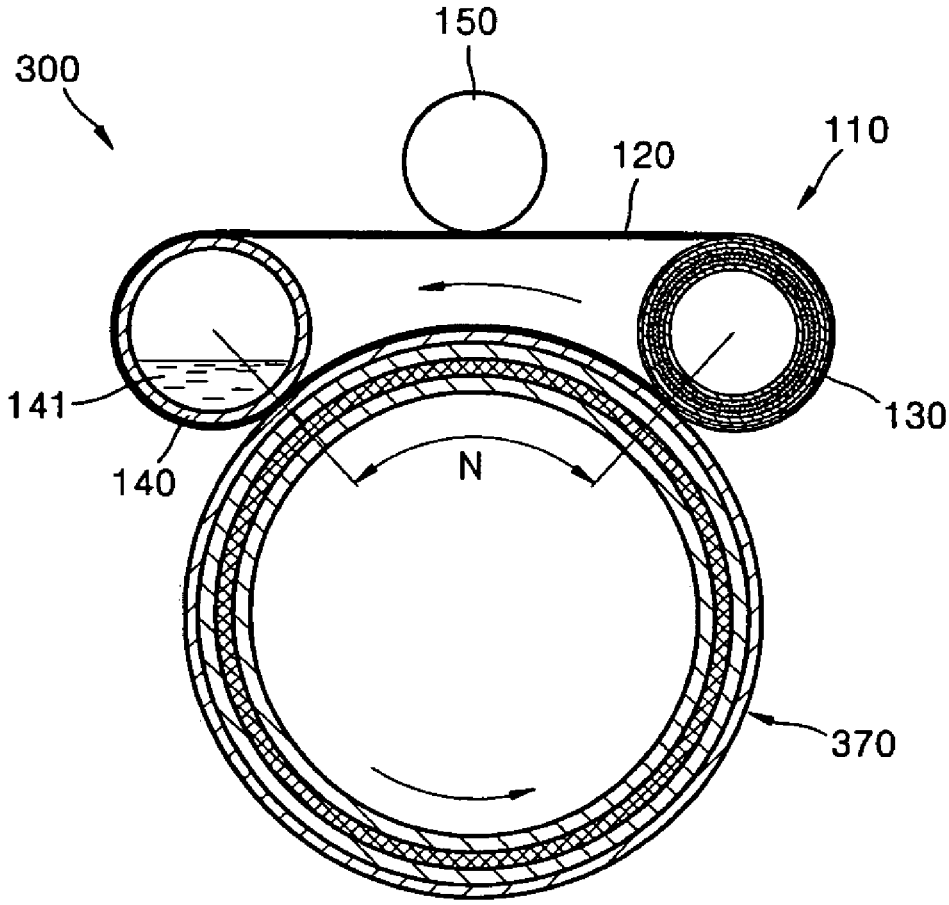
FIGS. 6 and 7 are cross-sectional views of a fusing device installed in an electro-photographic image forming apparatus, according to yet another embodiment of the present invention.
Figure 7:
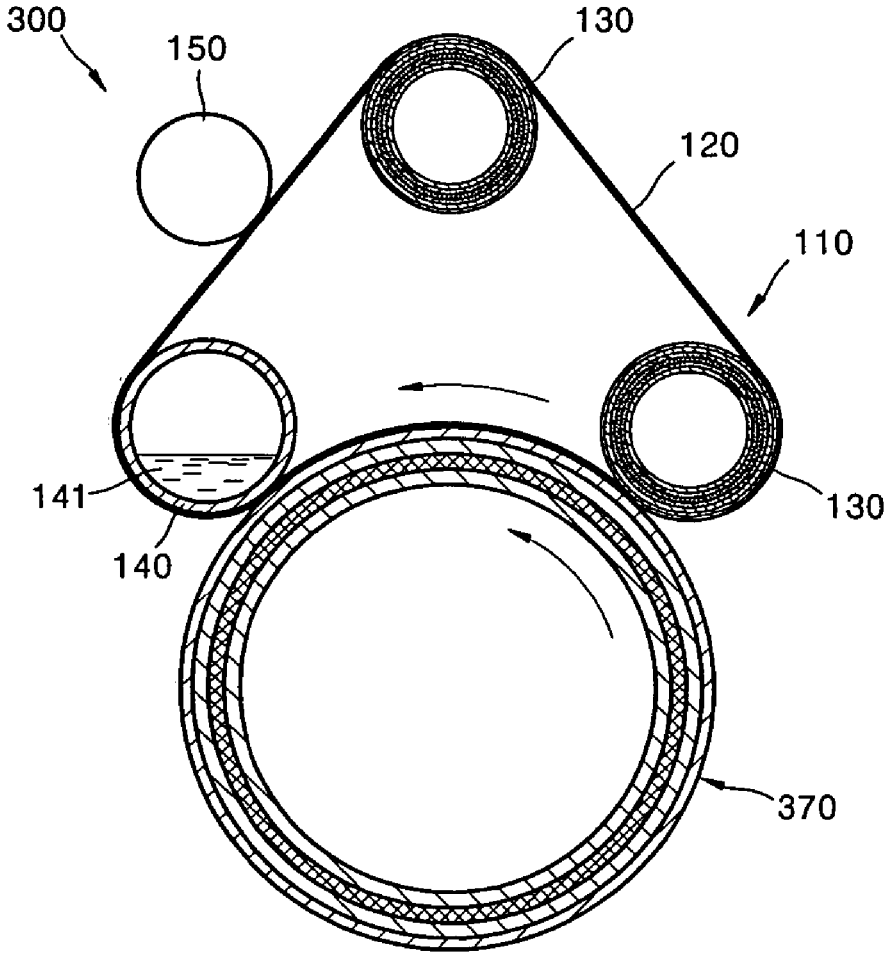

Referring to FIGS. 6 and 7, a fusing device 300 according to yet another embodiment of the present invention includes a fusing belt 110 and a pressurizing roller 370. Their constructions are similar to those of the fusing belt 110 and the first major heating roller 130 shown in FIGS. 2 and 3.

When paper S such as that shown in FIG. 2 to which an image T such as that shown in FIG. 2 is transferred, passes through a contact nip N between a continuous belt 120 and the pressurizing roller 370, the continuous belt 120 applies heat onto the image T and the pressurizing roller 370 applies heat and pressure onto the image T, thereby fusing the image T onto the paper S.

When a fusing device according to an embodiment of the present invention is applied to either a dry-type mono color printer or a dry-type color printer, it is possible to perform printing at a high speed since a contact nip between a fusing belt and a pressurizing roller is large. Also, when the fusing device is applied to a wet-type printer, an area of paper passing through the contact nip is great, and thus, it is possible to effectively evaporate a carrier and fuse an image, which is transferred to the paper, onto the paper.

As described above, a fusing device installed in an electro-photographic image forming apparatus, according to an embodiment of the present invention, has the following advantages. First, use of a heating roller that generates a lot of heat and a heat pipe with high-heat-storage capability, remove a need for a continuous power supply, thereby reducing power consumption.

Second, a heat source may be installed in a pressurizing roller if necessary, so that the pressurizing roller can apply both heat and pressure onto paper with an image, thereby effectively fusing the image onto the paper.

While this invention has been particularly shown and described with reference to exemplary embodiments thereof, it should be understood by those skilled in the art that various changes in form and details may be made therein without departing from the spirit and scope of the invention as defined by the appended claims.

What is claimed is:

1. A fusing device installed in an electro-photographic image forming apparatus, comprising:

a fusing belt having a continuous belt for rotating while being supported by at least two rollers, each of said rollers delivering heat to said continuous belt and to an image transferred onto paper, the rollers including a first major heating roller contacting the fusing belt and having a heat source, and an auxiliary heating roller contacting the fusing belt, where said fusing belt transfers heat to the auxiliary roller and where the auxiliary roller stores heat from the first major heating roller to heat the fusing belt; and a pressurizing roller for contacting the continuous belt in an area between said at least two rollers and applying pressure onto the paper.

2. The fusing device of claim 1, wherein the first major heating roller includes a resistance heating coil that is disposed between a first insulating layer and a second insulating layer, an inner layer is connected to the second insulating layer on the side opposite the resistance heating coil, an outer layer is connected to the first insulating layer on the side opposite the resistance heating coil.

3. The fusing device of claim 2, further comprising a second major heating roller for supplying heat to said continuous belt.

4. The fusing device of claim 3, wherein one of the major heating rollers and the auxiliary heating roller serves as a driving unit for rotating the continuous belt.

5. The fusing device of claim 3, wherein the first major heating roller, the second major heating roller and the auxiliary heating roller are disposed in a triangular arrangement with respect to each other.

6. The fusing device of claim 2, wherein the auxiliary heating roller includes a working fluid that allows the heat delivered by the first major heating roller to allow the continuous belt to have a uniform temperature distribution.

7. The fusing device of claim 2, wherein the auxiliary heating roller is made of copper.

8. The fusing device of claim 1, wherein the pressurizing roller includes a resistance heating coil disposed between a first insulating layer and a second insulating layer, an inner layer is connected to the second insulating layer on the side opposite the resistance heating coil, an outer layer is connected to the first insulating layer on the side opposite the resistance heating coil.

9. The fusing device of claim 1, wherein a halogen lamp is provided as a heat source in the pressurizing roller.

10. The fusing device of claim 1, further comprising a cleaning roller for rotating while contacting the continuous belt and removing residual substances remaining on the continuous belt.

11. The fusing device of claim 1, wherein said auxiliary heating roller is made of copper to provide high heat transferring properties.

12. The fusing device of claim 1, further comprising a second major heating roller supporting and heating the continuous belt, the first major heating roller, the second major heating roller and the auxiliary roller being disposed in a triangular configuration.

13. A method of fusing an image onto paper using a fusing device in an electro-photographic image forming apparatus, comprising:

rotating a fusing belt having a continuous belt supported by at least two rollers, each of said at least two rollers delivering heat to the continuous belt, and the continuous belt delivering the heat to an image transferred onto the paper, the rollers including a first major heating roller contacting the fusing belt and having a heat source, and an auxiliary heating roller contacting the fusing belt for transferring heat from the fusing belt to the auxiliary roller and storing heat in the auxiliary roller from the first major heating roller to heat the fusing belt; and contacting the continuous belt in an area between the rollers and applying pressure onto the paper via a pressurizing roller.

14. The method of claim 13, wherein the first major heating roller includes a resistance heating coil that is disposed between a first insulating layer and a second insulating layer, connecting an inner layer to the second insulating layer on the side opposite the resistance heating coil, and connecting an outer layer to the first insulating layer on the side opposite the resistance heating coil.

15. The method of claim 14, further comprising:

providing a second major heating roller to heat the continuous belt.

16. The method of claim 15, wherein one of the major heating rollers and the auxiliary heating roller serves as a driving unit for rotating the continuous belt.

17. The method of claim 15, wherein the first major heating roller, the second major heating roller and the auxiliary heating roller are disposed in a triangular arrangement with respect to each other.

18. The method of claim 14, wherein the auxiliary heating roller includes a working fluid that allows the heat delivered by the major heating roller to allow the continuous belt have a uniform temperature distribution.

19. The method of claim 14, wherein the auxiliary heating roller is made of copper.

20. The method of claim 13, wherein the contacting step further comprises:

providing a resistance heating coil in the pressurizing roller disposed between a first insulating layer and a second insulating layer, connecting an inner layer to the second insulating layer on the side opposite the resistance heating coil, and connecting an outer layer to the first insulating layer on the side opposite the resistance heating coil.

21. The method of claim 13, further comprising:

providing a halogen lamp as a heat source in the pressurizing roller.

22. The method of claim 13, further comprising:

providing a cleaning roller for rotating while contacting the continuous belt and removing residual substances remaining on the continuous belt.

23. The method of claim 13, wherein the auxiliary heating roller is made of copper to provide high heat transferring properties.

24. The method of claim 23, wherein the fusing device further includes a second major heating roller supporting and heating the continuous belt, the first major heating roller, the second major heating roller and the auxiliary roller being disposed in a triangular configuration.

25. An electro-photographic image forming apparatus comprising:

a fusing device having a continuous belt rotating and supported by a first major heating roller, a second major heating roller and an auxiliary heating roller arranged in a triangular configuration, said first and second major heating rollers supplying heat to said continuous belt to heat and fuse a toner image transferred to a paper; and a pressurizing roller contacting the continuous belt and applying pressure to the paper between the continuous belt and the pressurizing roller.

26. The image forming apparatus of claim 25, wherein said pressurizing belt contacts said continuous belt in an area between at least two of said rollers.

27. The image forming apparatus of claim 25, wherein said first heating roller includes a resistance heating coil positioned between a first insulating layer and a second insulating layer, an inner layer connected to the second insulating layer on a side opposite the resistance heating coil, and an outer layer connected to the first insulating layer on the side opposite the resistance heating coil.

28. The image forming apparatus of claim 25, wherein said continuous belt transfers heat to said auxiliary heating roller whereby said auxiliary heating roller provides uniform heating of said continuous belt.

29. The image forming apparatus of claim 28, wherein said auxiliary roller is made of copper and contains a working fluid to absorb heat from said continuous belt.

* * * * *